US007178606B2

(12) United States Patent
Pecchio

(10) Patent No.: US 7,178,606 B2
(45) Date of Patent: Feb. 20, 2007

(54) WORK IMPLEMENT SIDE SHIFT CONTROL AND METHOD

(75) Inventor: Patrick Michael Pecchio, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 214 days.

(21) Appl. No.: 10/927,319

(22) Filed: Aug. 27, 2004

(65) Prior Publication Data

US 2006/0042810 A1 Mar. 2, 2006

(51) Int. Cl.
*A01B 63/00* (2006.01)

(52) U.S. Cl. ..... 172/6; 172/781

(58) Field of Classification Search ..... 172/2, 172/3, 4.5, 5, 6, 781; 340/988, 978, 990; 37/348, 382; 701/50
See application file for complete search history.

(56) References Cited

U.S. PATENT DOCUMENTS

| | | | | |
|---|---|---|---|---|
| 5,490,081 A | | 2/1996 | Kuromoto et al. | 364/474.2 |
| 5,549,412 A | | 8/1996 | Malone | 404/84.1 |
| 5,553,407 A | | 9/1996 | Stump | 37/348 |
| 5,612,864 A | | 3/1997 | Henderson | 364/167.01 |
| 5,631,658 A | | 5/1997 | Gudat et al. | 342/457 |
| 5,647,439 A | | 7/1997 | Burdick et al. | 172/4.5 |
| 5,684,476 A | * | 11/1997 | Anderson | 340/988 |
| 5,704,141 A | | 1/1998 | Miura et al. | 37/348 |
| 5,764,511 A | | 6/1998 | Henderson | 364/167.01 |
| 5,784,944 A | | 7/1998 | Tozawa et al. | 91/361 |
| 5,951,613 A | | 9/1999 | Sahm et al. | 701/50 |
| 5,957,989 A | | 9/1999 | Egawa et al. | 701/50 |
| 5,964,298 A | * | 10/1999 | Greenspun | 172/4.5 |
| 6,027,282 A | | 2/2000 | Horn | 404/75 |
| 6,032,093 A | | 2/2000 | Denbraber et al. | 701/50 |
| 6,112,143 A | | 8/2000 | Allen et al. | 701/25 |
| 6,227,761 B1 | | 5/2001 | Kieranen et al. | 404/84.5 |
| 6,230,090 B1 | | 5/2001 | Takahashi et al. | 701/50 |
| 6,282,453 B1 | | 8/2001 | Lombardi | 700/63 |
| 6,282,477 B1 | | 8/2001 | Gudat et al. | 701/50 |

(Continued)

FOREIGN PATENT DOCUMENTS

WO WO 99/04106 1/1999

OTHER PUBLICATIONS

U.S. Appl. No. 10/738,046, filed Dec. 18, 2003, "Method and System of Controlling a Work Tool."

(Continued)

*Primary Examiner*—Victor Batson
(74) *Attorney, Agent, or Firm*—Finnegan, Henderson, Farabow, Garrett & Dunner

(57) ABSTRACT

A system for automatically moving a work implement of a work machine includes a position monitoring system configured to track a position of the work implement relative to a mapped landscape and programmable to incorporate an electronic representation of at least one entity designated to be avoided into the mapped landscape. The system also includes a controller configured to initiate movement of the work implement in response to information from the position monitoring system, including movement of the work implement to avoid the at least one entity. The work machine has a longitudinal axis aligned with a direction of travel of the work machine and the movement of the work implement includes movement of an edge of the work implement, nearest to the at least one entity, relative to a vertical plane containing the longitudinal axis.

18 Claims, 6 Drawing Sheets

U.S. PATENT DOCUMENTS

| | | | | |
|---|---|---|---|---|
| 6,287,048 | B1 | 9/2001 | Hollon et al. | 404/84.2 |
| 6,371,566 | B1 | 4/2002 | Haehn | 299/1.5 |
| 6,377,881 | B1 * | 4/2002 | Mullins | 701/50 |
| 6,415,604 | B1 | 7/2002 | Motomura et al. | 60/399 |
| 6,421,627 | B1 * | 7/2002 | Ericsson | 702/150 |
| 6,437,726 | B1 | 8/2002 | Price | 342/22 |
| 6,510,628 | B1 | 1/2003 | Koch | 37/348 |
| 6,520,715 | B1 | 2/2003 | Smith | 404/75 |
| 6,655,465 | B2 | 12/2003 | Carlson et al. | 172/4.5 |

OTHER PUBLICATIONS

U.S. Appl. No. 09/738,136, filed Dec. 16, 2000, "Method and Apparatus for Displaying an Excavation to Plan."

* cited by examiner

WORK IMPLEMENT SIDE SHIFT CONTROL AND METHOD

TECHNICAL FIELD

This disclosure is directed to a system and method for controlling the movement of a work implement and, more particularly, to a system and method for controlling side shift of a work implement.

BACKGROUND

Work machines such as motor graders, track-type tractors (e.g. bulldozers), wheeled tractors, loaders, excavators, etc. may include work implements for performing various functions. During operation, there may be entities, such as obstacles or barriers, that an operator of the work machine may wish to avoid. In some situations, it may be desirable to operate a work implement in close proximity to such entities, and in other situations, it may be desirable to simply avoid entities. In either situation, operation around entities can require considerable skill and attention on the part of a machine operator. However, even a skilled operator may be unable to avoid certain entities and achieve desired results in all situations. For example, an entity may be in a blind spot of the operator, the operator may not be able to see the entire work implement to judge its proximity to an entity, or it may be difficult to simultaneously operate the controls of the work implement with precision while operating the other functions of the machine.

Systems have been developed for automating certain functions of a work machine in an attempt to improve efficiency and reduce the skill level required to operate a machine. For example, U.S. Pat. No. 6,655,465 ("the '465 patent") issued to Carlson et al. on Dec. 2, 2003, describes a system and method for automatic control of a motor grader blade based on mapped information correlated to a worksite. The system of the '465 patent tracks the position of the blade as the motor grader traverses the work site landscape. This system is configured to automatically control the position of the blade based on the location of the blade with respect to the worksite. Specifically, the system of the '465 patent automatically positions the blade with respect to a reference line and prevents the blade from moving more than a certain distance away from the reference line.

Although the system of the '465 patent may improve blade placement and reduce the level of skill needed to operate the machine, it cannot automatically avoid entities at a work site. Further, the system of the '465 patent is not configured to maintain a certain distance between a work implement and entities at a work site. For example, while the system of the '465 patent maintains the blade within a pre-set path of travel, the system does not include automated features for entity avoidance.

The disclosed control system is directed towards overcoming one or more of the problems set forth above.

SUMMARY OF THE INVENTION

In one aspect, the present disclosure is directed to a system for automatically moving a work implement of a work machine. The work machine may include a longitudinal axis aligned with a direction of travel of the work machine. The system may include a position monitoring system configured to track a position of the work implement relative to a mapped landscape and programmable to incorporate an electronic representation of at least one entity into the mapped landscape. The system may also include a controller configured to initiate movement of the work implement in response to information from the position monitoring system, including movement of the work implement to avoid the at least one entity. The movement of the work implement may include movement of an edge of the work implement, nearest to the at least one entity, relative to a vertical plane containing the longitudinal axis.

In another aspect, the present disclosure is directed to a motor grader including a cab, a traction system, a power source, and a work implement having an edge. The motor grader may also include a longitudinal axis aligned with a direction of travel of the motor grader. The motor grader may further include a position monitoring system configured to track a position of the work implement relative to a mapped landscape. The position monitoring system may be programmable to incorporate an electronic representation of at least one entity designated to be avoided into the mapped landscape. The system may further include a controller configured to initiate movement of the work implement in response to information from the position monitoring system, which may include movement of the work implement to maintain a predetermined distance between the at least one entity and an edge of the work implement nearest to the entity. The movement of the work implement may include movement of the edge of the work implement relative to a vertical plane containing the longitudinal axis.

In another aspect, the present disclosure is directed to a method of controlling a work implement for a work machine. The work machine may include a longitudinal axis aligned with a direction of travel of the work machine. The method may include determining an actual position of a work implement relative to a mapped landscape. At least one predetermined entity designated to be avoided may be located with respect to the actual position of the work implement. A distance between the at least one predetermined entity and an edge of the work implement nearest to the at least one predetermined entity may be determined and movement of the work implement may be automatically controlled in response to a comparison of the distance to a predetermined distance. The movement of the work implement may include movement of the edge of the work implement relative to a vertical plane containing the longitudinal axis in order to avoid the at least one predetermined entity.

DETAILED DESCRIPTION

Figure 1:
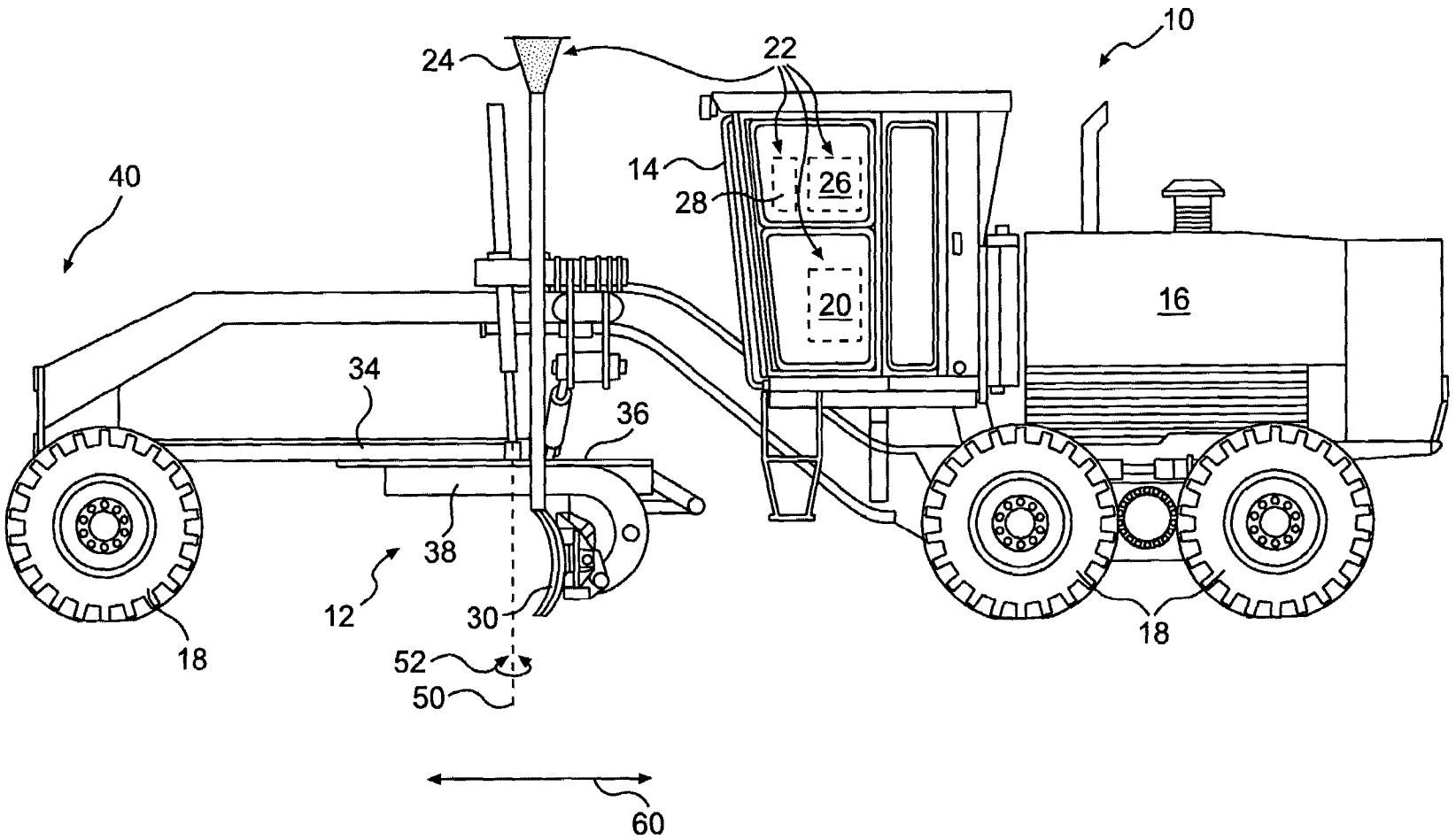
FIG. 1 is a diagrammatic illustration of a work machine according to an exemplary disclosed embodiment.

FIG. 1 illustrates an exemplary embodiment of a work machine 10, which includes a system for automatically moving a work implement 12. Although work machine 10 is shown as a motor grader, work machine 10 may include other types of work machines such as, for example, track-type tractors (e.g. bulldozers), wheeled tractors, loaders, excavators, and any other type of work machine. Work machine 10 may include work implement 12, a cab 14, a power source 16, one or more traction devices 18, a controller 20, and position monitoring system components 22, including one or more Global Positioning System (GPS) receivers 24, a processor 26, and a monitor display 28.

Figure 2:
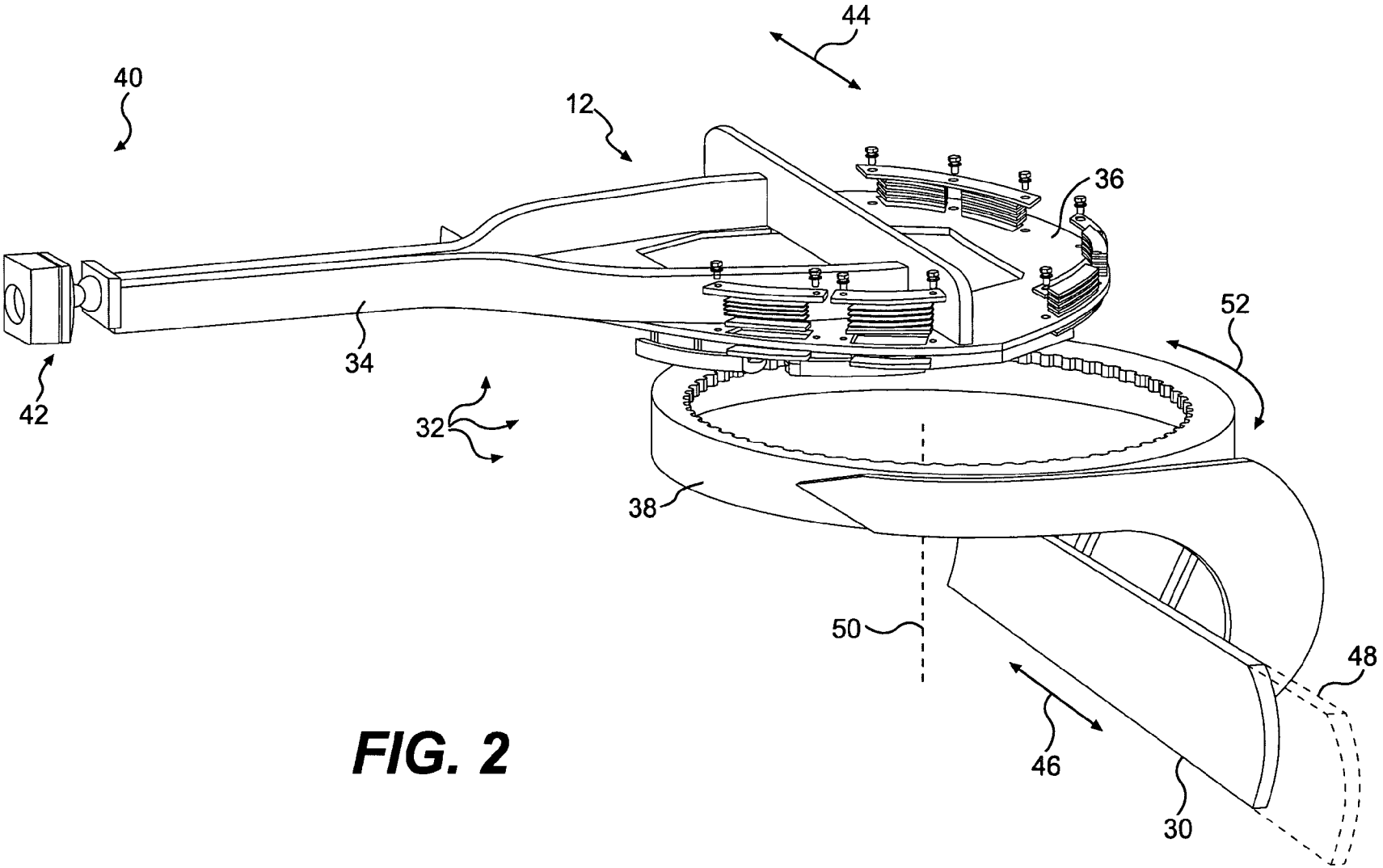
FIG. 2 is a diagrammatic exploded view illustration of a drawbar-circle-moldboard assembly according to an exemplary disclosed embodiment.

FIG. 2 depicts an exemplary embodiment of work implement 12. Work implement 12 may include a blade 30. In the case of a motor grader, blade 30 may be attached to a drawbar/moldboard/circle assembly (DMC) 32, which may include a drawbar 34, a moldboard 36, and a circle 38. Circle 38 may be rotatably attached to moldboard 36. Moldboard 36 may be attached to drawbar 34, which may be attached to a front portion 40 of work machine 10 with a pivoting joint 42.

Blade 30 may be adjusted in several degrees of freedom. In particular, blade 30 may be laterally shifted (side shift) in several different ways. For example, DMC 32 may be laterally translated in a direction 44 by moving drawbar 34 side to side. Because blade 30 may be attached to DMC 32, lateral translation of DMC 32 may result in a side shift of blade 30 in direction 46 as indicated by a dashed element 48. Also, blade 30 may be attached to an actuator mechanism (not shown) mounted on circle 38 behind blade 30 that may move blade 30 with respect to DMC 32 in direction 46.

Figure 3:
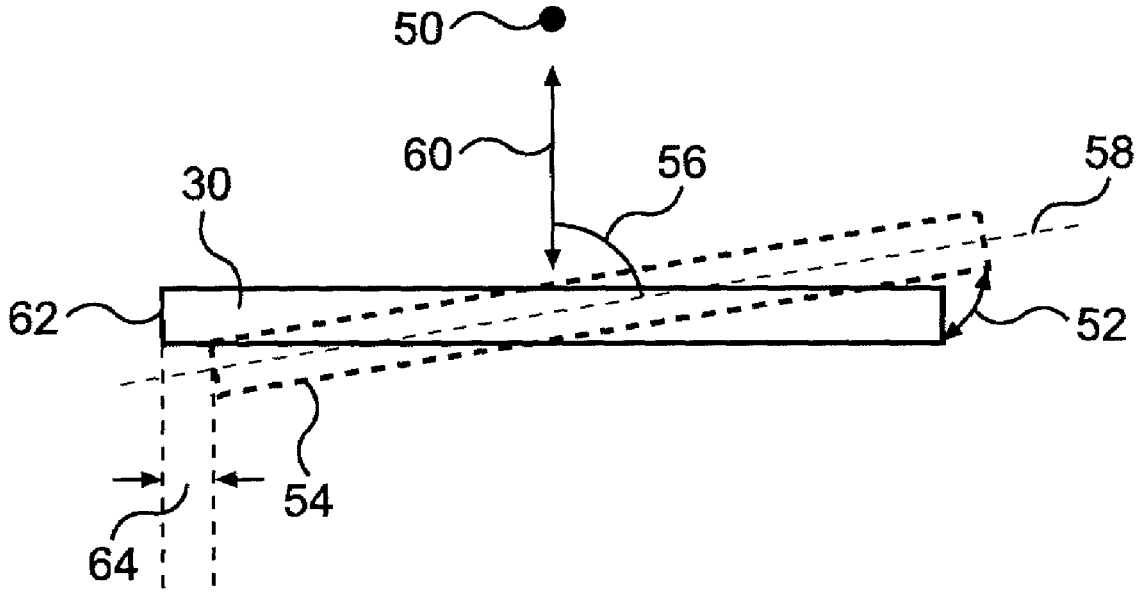
FIG. 3 is a diagrammatic top view representation of a work implement blade swivel motion according to an exemplary disclosed embodiment.

Additionally, an effective side shift may be accomplished by swiveling blade 30. Because circle 38 may be rotatably attached to moldboard 36 and fixedly attached to blade 30, rotation of circle 38 about an axis 50, in a direction 52, may translate into a swivel motion of blade 30. FIG. 3 is a top view of blade 30 showing a swivel motion of blade 30. A dashed element 54 represents blade 30 after it has been swiveled about axis 50. Swivel of blade 30 results in a change in an angle 56 between a longitudinal axis 58 of blade 30 and a direction of travel 60 of work machine 10. Swivel of blade 30 can also result in a side shift of blade 30 by causing a change in lateral position of an edge 62 of blade 30, as indicated by a distance 64.

Figure 4:
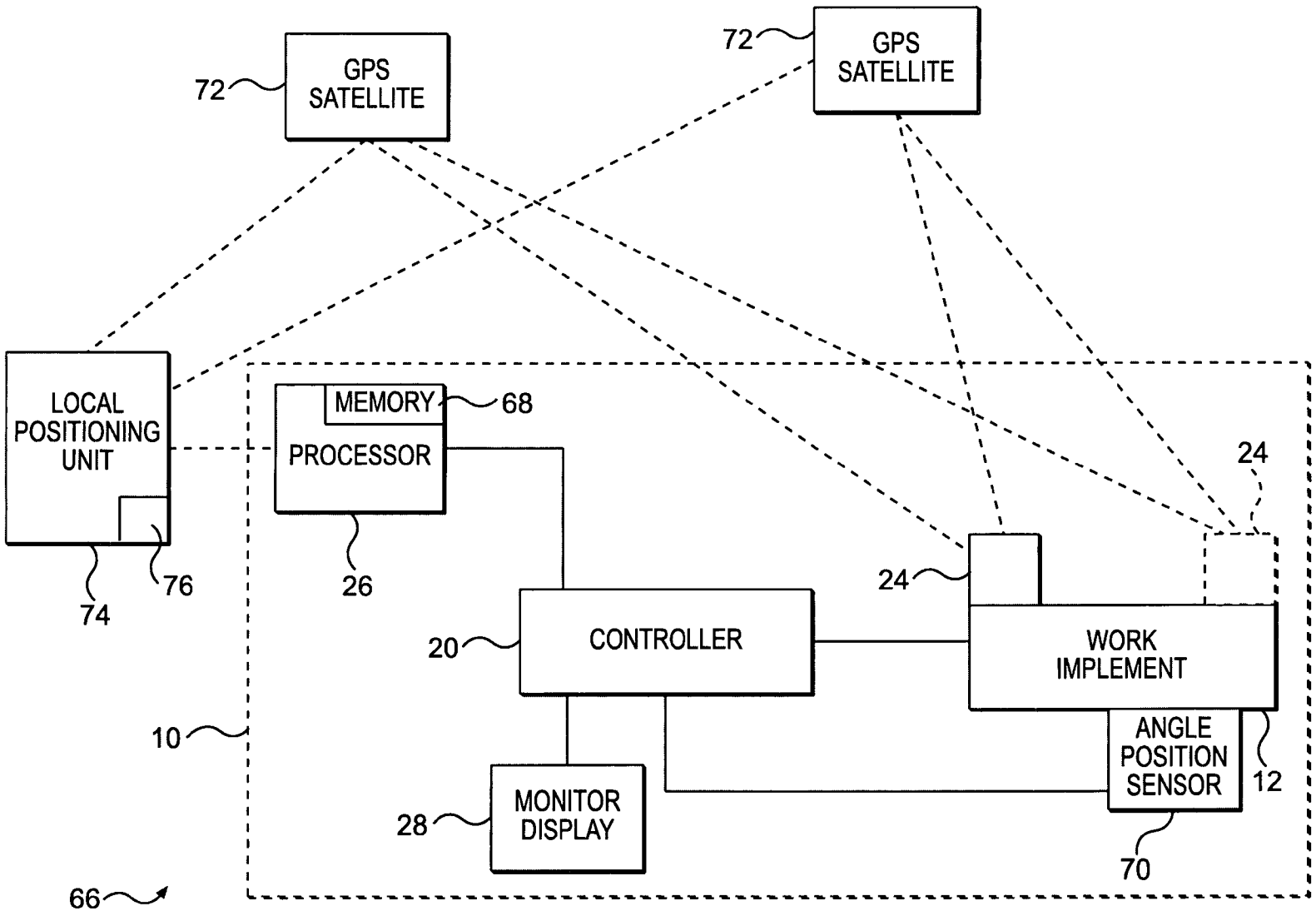
FIG. 4 is a block diagram representation of a work implement control system according to an exemplary disclosed embodiment.

Referring to FIG. 4, work machine 10 may include a position monitoring system 66, which may be configured to track the position of work implement 12 relative to a mapped landscape. Position monitoring system 66 may include controller 20, GPS receivers 24, processor 26, monitor display 28, a memory 68, and an angle position sensor 70.

Position monitoring system 66 may include memory 68 for storing information. Memory 68 may be incorporated into a unit with controller 20 or with processor 26 or in a single unit including both controller 20 and processor 26. Memory 68 may store maps of a work site. The maps stored by memory 68 may also include entities such as obstacles and barriers. These obstacles may include existing structural entities, such as, for example, buildings, utilities infrastructure, fences, curbs, and any other structure to be avoided by a work implement. Possible barriers may include intangible entities, such as, for example, easements, building envelopes, property lines, or any other type of arbitrary boundary. Other possible entities may include projected locations of obstacles or barriers that have yet to be established. For example, while developing a new roadway, a mapped entity representing the intended edge of the roadway may assist an operator in creating the roadway.

Maps may be downloaded or programmed into position monitoring system 66 from an outside source. For example, when work machine 10 is designated for use at a particular work site, pre-established maps of that work site may be downloaded into memory 68. The locations and characteristics of entities may also be programmed into memory 68 as part of a mapped landscape at any given time. For example, coordinates or outlines of entities may be downloaded as part of the pre-established maps discussed above, or entered by an operator of work machine 10 at the work site.

Downloading or programming of information into memory 68 may be performed using external devices such as laptops, PDAs, etc. Information transfer to memory 68 may also be performed wirelessly with a network connection to laptops, PDAs, etc., or to a central server at an offsite location.

In addition, position monitoring system 66 may be used to generate maps. For example, position monitoring system 66 may record the areas over which work machine 10 was driven, and may establish a map of the work site that indicates areas that were not traversed by work machine 10 as entities. For example, an operator may drive work machine 10 over an entire work site except for an area occupied by an existing building. Position monitoring system 66 may establish a map of the work site that indicates the area that was not driven over (i.e. the location of the existing building) as an entity. This mapped entity may be designated as an obstacle to be avoided.

Memory 68 may also store other information, such as, for example, positional information about work machine 10 and/or work implement 12. This information may also be incorporated into one or more maps of the worksite. As an example, memory 68 may store a positional history of where work machine 10 and/or work implement 12 have been (e.g. the route taken by the operator) in the work site.

Position monitoring system 66 may also include monitor display 28 in cab 14 for displaying information to an operator. Monitor display 28 may be any kind of display, including screen displays, such as, for example, cathode ray tubes (CRTs), liquid crystal displays (LCDs), plasma screens, and the like.

Monitor display 28 may display maps stored in memory 68 or maps generated by position monitoring system 66. Monitor display 28 may also represent the past, present, and/or projected future position and orientation of work machine 10 and/or work implement 12 in relation to the maps. For example, monitor display 28 may show a trail indicating where work machine 10 has traveled within the work site. Similarly, monitor display may show a projected route based on the current heading of work machine 10, or a suggested route for the operator to follow. Monitor display 28 may also display other information such as, for example, the amount of time the machine has been operating, work machine systems information (e.g. oil pressure, hydraulic fluid pressure, coolant temperature, etc.), and any other information desired to be displayed to the operator, owner, service technician, or anyone else who may view monitor display 28.

Position monitoring system 66 may further include processor 26. Processor 26 may be located at any suitable location on work machine 10. Processor 26 may be contained in its own housing or, alternatively, may be housed with other components of work machine 10.

Processor 26 may receive information from any source from which information is desired to be processed. In particular, processor 26 may receive information about the position and orientation of work implement 12, including its position with respect to mapped entities, as well as the speed of work machine 10. Processor 26 may receive this information from GPS receivers 24, memory 68, angle position sensor 70, and a work machine speed sensor (not shown).

Processor 26 may be configured to determine which movements of work implement 12 are desired and at what rate they should be made, based on information it receives. Processor 26 may send signals to controller 20 communicating these desired movements. Processor 26 may also be configured to send signals to monitor display 28 to display the information that processor 26 receives and/or processes.

Controller 20 may also be located at any suitable location on work machine 10. Controller 20 may be contained in its own housing or, alternatively, may be housed with other components of work machine 10, including for example, processor 26. Controller 20 may be an integral part of position monitoring system 66, as shown in FIG. 4. Alternatively, controller 20 may be a separate component from position monitoring system 66. Controller 20 and processor 26 may be independent components if, for example, position monitoring system 66 has been retrofitted to work machine 10, wherein work machine 10 was already equipped with controller 22. As a further alternative, one of controller 20 and processor 26 may be omitted and its functions performed by the other.

In any of the aforementioned arrangements, controller 20 may be configured to receive information from processor 26 regarding the desired movements of work implement 12. Controller 20 may also be configured to initiate movements of work implement 12 in response to information from processor 26. Controller 20 may be configured to initiate swivel, side shift, and any other desired movements of work implement 12. In addition, controller 20 may be configured to vary the rate of movement of work implement 12 as determined by processor 26, based on the speed of work machine 10 and/or a distance to a predetermined area or entity.

Position monitoring system 66 may also include one or more GPS receivers 24 for receiving signals from one or more GPS satellites 72. A local positioning unit 74 may be used to supplement GPS receivers 24. Local positioning unit 74 may be a reference station, at or near the work site, which enables GPS receivers 24 to more accurately monitor the position of work implement 12.

In operation, each of GPS receivers 24 may communicate with one or more GPS satellites 72 to determine its position with respect to a selected coordinate system. GPS receivers 24 may be attached to one or more locations on work implement 12, preferably at one or both ends.

A single GPS receiver 24 mounted on work implement 12 may determine the position of work implement 12 relative to a mapped landscape. With more than one GPS receiver 24, the orientation of work implement 12 may also be determined. In an exemplary embodiment, work implement 12 may have two GPS receivers 24 mounted on it. The two GPS receivers 24 may be placed at or near the ends of work implement 12, so as to determine the position of each of the ends. By knowing the position of each end of work implement 12, processor 26 may determine the orientation of work implement 12. For example, processor 26 may determine swivel angle by determining the position of the two ends of work implement 12 relative to one another.

While two GPS receivers 24 may be mounted on work implement 12, certain embodiments may include just one GPS receiver 24 mounted on work implement 12. In an exemplary embodiment, work implement 12 may have a single GPS receiver 24 at one end, for determining its location at a work site. Angle position sensor 70 may be included on work implement 12 for determining swivel angle. The position of one end of work implement 12 may be determined by GPS receiver 24. The swivel angle of work implement 12 may be determined by angle position sensor 70, rather than by determining the position of both ends of work implement 12 with GPS receivers 24.

Local positioning unit 74 may be any system for determining the position of work implement 12 in a coordinate system. Local positioning unit 74 may be placed at a surveyed location with a known position. Local positioning unit 74 may be part of a differential GPS (DGPS), and may include a GPS receiver 76. GPS receiver 76 may be used to determine the position of local positioning unit 74. Any discrepancy between the actual, known position of local positioning unit 74 (as established by survey) and its determined position obtained using GPS receiver 76 may be considered to be error on the part of GPS receiver 76. A correction factor may be generated to compensate for any discrepancy and may be used to correct errors in the determined positions of local positioning unit 74 that are obtained using GPS receiver 76. This correction factor may also be applied to determined positions obtained using other GPS receivers in the vicinity. Accordingly, the correction factor may be used to modify the determined position of work implement 12 that is obtained using GPS receivers 24. Use of this correction factor may enable a more accurate position of work implement 12 to be determined.

Alternatively, local positioning unit 74 may be a laser-based system for determining the position of work implement 12 in the work site. Local positioning unit 74 may include a transceiver for communicating with work machine 10. Such systems may be used in a similar manner to a differential GPS as discussed above to improve the accuracy of position monitoring system 66.

Figure 5:
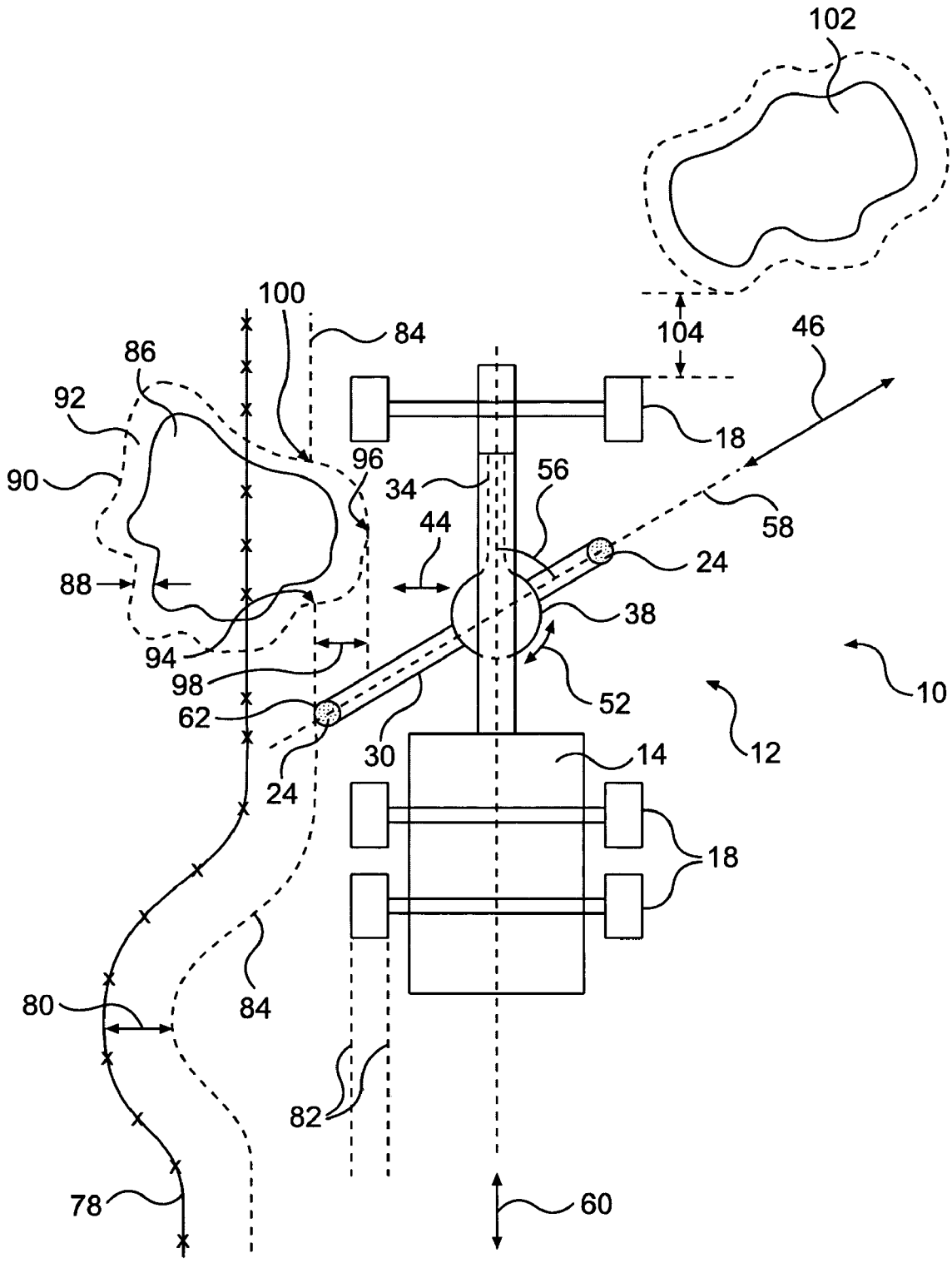
FIG. 5 is a diagrammatic top view representation of a work machine at a work site according to an exemplary disclosed embodiment.
Figure 6:
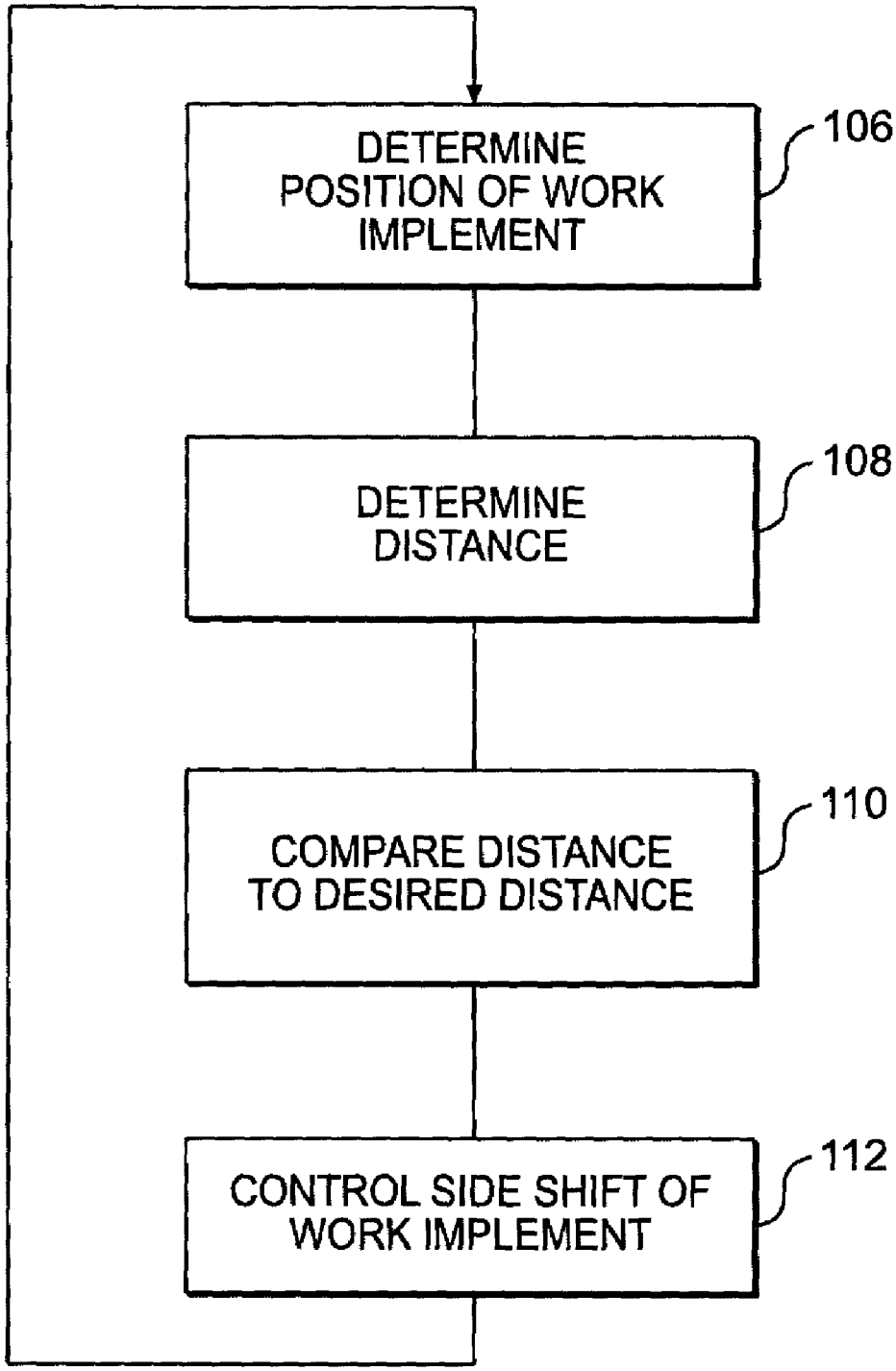
FIG. 6 is a flow chart of a process for controlling side shift of a work implement according to an exemplary disclosed embodiment.

FIGS. 5 and 6, which are discussed in the following section, illustrate the operation of a work machine utilizing embodiments of the disclosed system.

INDUSTRIAL APPLICABILITY

The disclosed system may be applicable to a variety of work machines, including motor graders, track-type tractors (e.g. bulldozers), wheeled tractors, loaders, excavators, and any other work machine that may include a work implement. The disclosed system provides automation of work implement motion that can increase efficiency and accuracy of work machine operations.

The use of work machines can involve operation around entities. These entities may include existing structural obstacles, such as, for example, buildings, utilities infrastructure, fences, curbs, and any other structure to be avoided by a work implement. Other possible entities include intangible boundaries, such as, for example, easements, building envelopes, property lines, or any other type of arbitrary boundary.

It may be desirable to operate work implement 12 within close proximity to these entities. The disclosed control system may automatically move work implement 12 such that, when in close proximity to a predetermined entity, a buffer distance is maintained between the entity and an edge of work implement 12 nearest to the entity. For example, when operating work implement 12 around an entity such as a building, a buffer distance may be maintained between work implement 12 and the building, in order to keep work implement 12 from contacting the building.

The buffer distance may be selectable, by an owner, operator, service technician, or anyone else having an interest in such a setting. Alternatively, the buffer distance may be preprogrammed. The buffer distance may be the same for all entities in a particular mapped landscape or may be different for different entities or different kinds of entities. For example, all easements may have a five foot buffer distance associated with them, whereas all building structures may have a three foot buffer distance. In addition, it may be possible to set different buffer distances for different boundaries about the same entity. For example, the buffer distance along one side of a building may be set at a different value than the buffer distance along another side of the building.

In some situations it may be desired to maintain no buffer distance at all between work implement 12 and an entity. For example, in the case of a roadway under construction, it may be desired to maintain an edge of work implement 12 exactly at an intended edge or other feature of the roadway. In such a case, it may be desirable to simply set a buffer distance of zero.

Referring to FIG. 5, controller 20 may be configured to maintain a pre-determined buffer distance between work implement 12 and an entity. The buffer distance may be as large or small as desired and may be maintained within a predetermined range of accuracy. As an example, it may be desired to follow along an entity 78 with work implement 12, as shown in FIG. 5. Because entity 78 may be an existing structure, it may be desired to maintain a predetermined buffer distance 80 between work implement 12 and entity 78. Work machine 10 may be driven in a straight line, as indicated by a set of dashed lines 82, while the side shift of work implement 12 may be controlled to maintain edge 62 along a boundary line 84, which is at predetermined buffer distance 80 from entity 78.

Controller 20 may also be configured to avoid an entity, without necessarily following along the entity. Referring again to FIG. 5, it may be desired to avoid a predetermined area occupied by an entity 86. Further, it may be desired for work implement 12 to avoid entity 86 by at least a predetermined buffer distance 88. For example, as work machine 10 approaches entity 86, it may be driven in a straight line as indicated by dashed lines 82. Work implement 12 may have a preferred path wherein edge 62 follows along boundary line 84 in order to follow a contour of entity 78. A boundary line 90 at buffer distance 88 from entity 86 may define a buffer zone 92 about entity 86. When edge 62 reaches a location 94 at the intersection of boundary line 84 and boundary line 90, work implement 12 may begin to side shift in order to avoid entity 86 and buffer zone 92 about entity 86. By the time edge 62 reaches a location 96 to the far right of entity 86, it will have side shifted by at least a distance 98 from its preferred path along boundary line 84.

In contrast to following a contour of entity 78, where the distance between edge 62 and entity 78 may be maintained at predetermined buffer distance 80, during avoidance of entity 86, the distance between edge 62 and entity 86 may become greater than predetermined buffer distance 88. Therefore, once work implement 12 reaches location 96, it may maintain its lateral position as work machine 10 proceeds forward. Alternatively, work implement 12 may automatically side shift back toward its preferred position along boundary line 84, thereby following the contour of boundary line 90 around a portion of entity 86. However, When edge 62 reaches boundary line 84 at a location 100 it may cease to follow along boundary line 90 and proceed along boundary line 84, thus increasing the distance between edge 62 and entity 86 to be greater than buffer distance 88.

The rate of movement of work implement 12 may be linked to the speed of work machine 10. For example, the rate of movement may increase with the speed of work machine 10. Conversely, the rate of movement may also be decreased as the speed of work machine 10 increases. The relationship may or may not be linear and may be described with many different functions, including, but not limited to, non-linear functions, step functions, and exponential functions. The relationship between the rate of movement and the speed of work machine 10 may be varied during operation of work implement 12. For example, the rate of movement may decrease linearly as the speed of work machine 10 decreases, but, as the speed of work machine 10 approaches zero, the rate of movement may decrease less rapidly, so as to avoid reducing the rate of movement too much. Similarly, as the speed of work machine 10 approaches its maximum, the rate of movement may increase less rapidly, so as to avoid moving too fast, or too much.

The rate of movement may also depend on the distance between work machine 10 and one or more entities. This relationship may vary as greatly as the relationship between rate of movement and the speed of work machine 10 discussed above. Also, the relationship may be varied during operation of work implement 12. For example, when work machine 10 is relatively close to an entity 102, work implement 12 may be required to side shift significantly over a short distance 104 of machine travel in order to avoid entity 102. Therefore, initially, the short distance 104 to entity 102 would require a relatively fast side shift movement of work implement 12. However, as work machine 10 approaches entity 102 (i.e. as a distance 104 from work machine 10 to entity 102 approaches zero) and work implement 12 approaches the desired position and/or orientation, the rate of side shift movement would slow down.

FIG. 6 illustrates one possible method of controlling side shift. At step 106, position monitoring system 66 may determine an actual position of work implement 12 relative to a work site. This position may be determined by processor 26, using information from one or more GPS receivers, as discussed above.

At 108, a distance may be determined between work implement 12 and one or more entities in the mapped landscape. Position monitoring system 66 may compare the position of work implement 12 with that of one or more mapped entities, and may thereby determine a distance between the one or more entities and the edge of work implement 12 nearest to each individual entity. In order to perform this step, position monitoring system 66 may determine the distance to all entities in a mapped landscape, or a smaller subset thereof. For example, position monitoring system 66 may only determine the distance to the entities forward of work machine 12.

At 110, processor 26 may perform a comparison between the distance determined at step 124 and a predetermined buffer distance. As discussed above, the predetermined buffer distance may be selectable.

At 112, controller 20 may control movement of work implement 12 based on the comparison between the two differences. Specifically, controller 20 may side shift work implement 12 to maintain a predetermined buffer distance between work implement 12 and the entity, or to simply avoid the entity. The process may repeat, continuously analyzing the landscape and controlling work implement 12 based on that analysis.

It will be apparent to those skilled in the art that various modifications and variations can be made to the disclosed work implement side shift control system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A system for automatically moving a work implement of a work machine, comprising:

a position monitoring system configured to track a position of the work implement relative to a mapped landscape and programmable to incorporate an electronic representation of at least one entity into the mapped landscape; and a controller configured to initiate movement of the work implement in response to information from the position monitoring system, including movement of the work implement to avoid the at least one entity;

wherein the work machine has a longitudinal axis aligned with a direction of travel of the work machine and the movement of the work implement includes movement of an edge of the work implement, nearest to the at least one entity, relative to a vertical plane containing the longitudinal axis.

2. The system of claim 1, wherein the work implement includes a blade.

3. The system of claim 2, wherein the blade is attached to a drawbar/moldboard/circle assembly (DMC).

4. The system of claim 3, wherein the movement of the edge is achieved by one or more of swivel of the blade and lateral translation of the blade.

5. The system of claim 1, wherein the position monitoring system is configured to track the position of the work implement.

6. The system of claim 1, wherein the position monitoring system is configured to generate a map of the landscape and store the map in a memory.

7. The system of claim 1, wherein the position monitoring system includes one or more global positioning system (GPS) receivers.

8. The system of claim 7, wherein the position monitoring system is configured to receive data from a local positioning unit for supplementing information provided by the one or more GPS receivers.

9. A motor grader comprising:

a cab:

a traction system;

a power source;

a work implement;

a position monitoring system configured to track a position of the work implement relative to a mapped landscape and programmable to incorporate an electronic representation of at least one entity into the mapped landscape; and a controller configured to initiate movement of the work implement in response to information from the position monitoring system, including movement of the work implement to maintain a predetermined distance between the at least one entity and an edge of the work implement nearest to the at least one entity;

wherein the motor grader has a longitudinal axis aligned with a direction of travel of the motor grader and the predetermined distance is maintained by movement of the edge of the work implement relative to a vertical plane containing the longitudinal axis.

10. The motor grader of claim 9, wherein the predetermined distance is maintained within a predefined range of accuracy.

11. The motor grader of claim 9, wherein the work implement includes a blade.

12. The motor grader of claim 11, wherein the blade is attached to a drawbar/moldboard/circle assembly (DMC).

13. The motor grader of claim 12, wherein the movement of the edge is achieved by at least one of swivel of the blade and lateral translation of the blade.

14. The motor grader of claim 9, wherein the position monitoring system is configured to track the position of the work implement.

15. The motor grader of claim 9, wherein the position monitoring system is configured to generate a map of the landscape and store the map in a memory.

16. The motor grader of claim 9, wherein the position monitoring system includes one or more global positioning system (GPS) receivers.

17. The motor grader of claim 16, wherein the position monitoring system is configured to receive data from a local positioning unit for supplementing information provided by the one or more GPS receivers.

18. The motor grader of claim 9, wherein the work implement includes a blade attached to a drawbar/moldboard/circle assembly (DMC), such that the movement of the edge is achieved by at least one of swivel of the blade and lateral translation of the blade; and wherein the position monitoring system includes one or more global positioning system (GPS) receivers and is configured to receive data from a local positioning unit for supplementing information provided by the one or more GPS receivers.

* * * * *